US011553293B2

(12) United States Patent
Liu et al.

(10) Patent No.: US 11,553,293 B2
(45) Date of Patent: Jan. 10, 2023

(54) FTINNITUS SHIELDING DEVICE AND SIGNAL PROCESSING METHOD THEREOF

(71) Applicant: AWNT LIMITED, New Taipei (TW)

(72) Inventors: Yi-Chang Liu, New Taipei (TW); Li-Min Sun, Beijing (CN)

(73) Assignee: AWNT LIMITED, New Taipei (TW)

( * ) Notice: Subject to any disclaimer, the term of this patent is extended or adjusted under 35 U.S.C. 154(b) by 28 days.

(21) Appl. No.: 17/369,941

(22) Filed: Jul. 7, 2021

(65) Prior Publication Data

US 2022/0014862 A1 Jan. 13, 2022

(30) Foreign Application Priority Data

Jul. 7, 2020 (TW) ..... 109122923

(51) Int. Cl.
*H04R 25/00* (2006.01)

(52) U.S. Cl.
CPC ..... *H04R 25/75* (2013.01); *H04R 25/505* (2013.01)

(58) Field of Classification Search
CPC .... H04R 25/75; H04R 25/505; H04R 25/353; A61F 11/00
See application file for complete search history.

(56) References Cited

U.S. PATENT DOCUMENTS

2009/0088598 A1* 4/2009 Abolfathi ..... H04R 25/604 600/25
2011/0046435 A1* 2/2011 Jensen ..... H04R 25/505 600/28
2012/0041298 A1* 2/2012 Mersky ..... H04R 25/554 324/309
2017/0195803 A1* 7/2017 Anderson ..... H04R 25/453

* cited by examiner

*Primary Examiner* — Tuan D Nguyen

(57) ABSTRACT

A tinnitus shielding device primarily includes an audio pick-up circuit, a processor, and a speaker in a case. The audio pick-up circuit receives a sound from an outer environment to generate a sound signal, and the processor processes the sound signal to compare a sound frequency in each of a plurality of audio components according to a configuration data and generates an output audio component by a frequency shifting process to at least one of the sound frequency which conforming to the configuration data. Then the processor combines the output audio component and the audio components those are not shifted to generate an output sound signal, to allow the speaker to output the output sound signal. Accordingly, the tinnitus shielding device of the present disclosure provides automatically shielding the sound frequency which may cause tinnitus discomfort to the user, to avoid the problem with tinnitus thereby.

14 Claims, 4 Drawing Sheets

FTINNITUS SHIELDING DEVICE AND SIGNAL PROCESSING METHOD THEREOF

CROSS-REFERENCE TO RELATED APPLICATION

The present disclosure is based upon and claims priority to Taiwan Patent Application No. 109122923, filed on Jul. 7, 2020, the content of which is incorporated herein by reference in its entirety for all purposes.

BACKGROUND

1. Technical Field

The present disclosure relates to a field of tinnitus shielding, and more particularly to a tinnitus shielding device and signal processing method thereof that shifting a sound frequency which causes tinnitus of a user to the sound frequency that the user can hear.

2. Description of the Related Art

Tinnitus may be caused by a variety of reasons as to know at present, for example, problems in the brain, nerves, cochlear, or a certain auditory cognitive pathway. In clinical trials, tinnitus has severely affected daily life for most people, and severe tinnitus can interrupt daily functions from sleep to work, often makes patients feel anxiety, depression, and other distressing behaviors.

However, since the variety of reasons may possibly lead to tinnitus, and complicated brain operation is involved. Currently, a high proportion of patients who cannot find the cause, and effective treatment or moderation methods are difficult to provide even the cause is known.

Therefore, how to provide a device which can shield a sound frequency that leading to tinnitus is required to solve the problems existing in the prior art.

SUMMARY

The purpose of the present disclosure is to provide a tinnitus shielding device, which primarily utilizes a processor to compare a sound frequency that can cause tinnitus, and then uses a frequency shifting process to shift the sound frequency to a sound frequency that does not cause tinnitus. Accordingly, automatically shielding the sound frequency that can cause tinnitus to a user, and effectively solving the problems of the prior art thereby.

Based on the purpose of the present disclosure, a tinnitus shielding device is provided, which comprises: a case; an audio pick-up circuit disposed in the case and receiving a sound signal from an outer environment; a processor disposed in the case and connected to the audio pick-up circuit, the processor receiving the sound signal and extracting a plurality of audio components from the sound signal, comparing a sound frequency in each of the plurality of audio components with at least one target frequency stored in a configuration data and generating an output audio component by performing a frequency shifting process to at least one of the audio component with the sound frequency conforming to the target frequency stored in the configuration data, and performing a combining process to combine the output audio component with the audio components those being not shifted in order to generate an output sound signal; and a speaker disposed in the case and connected to the processor to receive and output the output sound signal.

In an embodiment, the frequency shifting process is performed to shift the sound frequency to a shifted frequency other than the target frequency stored in the configuration data, and the output audio component is generated with the shifted sound frequency.

In an embodiment, the configuration data comprises at least one tinnitus sound frequency data representing the target frequency, the processor compares the sound frequency of the plurality of audio components based on the tinnitus sound frequency data and performs the frequency shifting process to the audio component having the sound frequency conforming to the tinnitus sound frequency data.

In an embodiment, the frequency shifting process is performed to shift the sound frequency to a shifted frequency other than the target frequency representing by the tinnitus sound frequency data, and the output audio component is generated with the shifted sound frequency.

In an embodiment, the tinnitus shielding device further includes: a register connected to the processor for storing the configuration data, the plurality of audio components, the output audio component, the sound frequencies, the output sound signal, or any combinations of two or more thereof.

In an embodiment, the tinnitus shielding device further includes: a configuration module disposed in the case, the configuration module connected to an external electronic device to receive the configuration data, or the configuration module providing a configuration interface to receive the configuration data set by a user.

In an embodiment, the tinnitus shielding device further includes: an activator disposed in the case and connected to the audio pick-up circuit and the processor, wherein the activator activates the processor to extract the plurality of audio components when the activator receives the sound signal from the audio pick-up circuit, or the processor is in a standby state when the activator does not receive the sound signal.

Another purpose of the present disclosure is to provide a signal processing method for a tinnitus shielding device, which primarily utilizes a processor to compare a sound frequency that can cause tinnitus, and then uses a frequency shifting process to shift the sound frequency to a sound frequency that does not cause tinnitus. Accordingly, automatically shielding the sound frequency that can cause tinnitus to a user, and effectively solving the problems of the prior art thereby.

Based on another purpose of the present disclosure, which provides a signal processing method for a tinnitus shielding device, applicable to the tinnitus shielding device, the signal processing method comprises: receiving a sound by an audio pick-up circuit from an outer environment and generating a sound signal by the audio pick-up circuit; extracting a plurality of audio components by a processor from the sound signal; comparing one sound frequency in the plurality of audio components with at least one target frequency stored in a configuration data by the processor; generating an output audio component by the processor by performing a frequency shifting process to at least one of the audio component with the sound frequency conforming to the target frequency stored in the configuration data; performing a combining process by the processor to combine the output audio component and the audio components those being not shifted in order to generate an output sound signal; and receiving and outputting the output sound signal by a speaker.

In an embodiment, the frequency shifting process is performed the sound frequency to a shifted frequency other than the target frequency stored in the configuration data, and the output audio component is generated with the shifted sound frequency.

In an embodiment, the configuration data comprises at least one of tinnitus sound frequency data representing the target frequency, the processor compares the sound frequency of the plurality of audio components based on the tinnitus sound frequency data and performs the frequency shifting process to the audio component having the sound frequency conforming to the tinnitus sound frequency data.

In an embodiment, the frequency shifting process is performed to shift the sound frequency to a shifted frequency other than the target frequency representing by the tinnitus sound frequency data, and the output audio component is generated with the shifted sound frequency.

In an embodiment, the signal processing method further includes: storing the configuration data, the plurality of audio components, the output audio component, the sound frequencies, the output sound signal, or any combinations of two or more thereof by a register.

In an embodiment, the signal processing method further includes: receiving the configuration data from an external electronic by a configuration module; or providing a configuration interface by the configuration module to receive the configuration data set by a user.

In an embodiment, the signal processing method further includes: activating the processor to extract the plurality of audio components by an activator when the activator received the sound signal from the audio pick-up circuit; or making the processor staying in a standby state by the processor when the activator does not receive the sound signal from the audio pick-up circuit.

In order to lead the purposes, features, and advantages of the present disclosure as described above can be obviously understandable, the specific embodiments listed in the drawings are described in detail below.

DESCRIPTION OF THE PREFERRED EMBODIMENTS

The advantages, features, and technical methods of the present disclosure are to be explained in detail with reference to the exemplary embodiments and the drawings for a better understanding of the present disclosure. Moreover, the present disclosure may be realized in different forms, and should not be construed as being limited to the embodiments set forth herein. Conversely, for a person of ordinary skill in the art, the embodiments provided shall make the present disclosure convey the scope more thoroughly, comprehensively, and completely. In addition, the present disclosure shall be defined only by the appended claims.

The terms used in the present disclosure are only for the purpose of describing specific embodiments, not intended to limit the present disclosure. Unless otherwise defined, the technical terms or scientific terms used in the present disclosure shall have the usual meanings understood by those with ordinary skills in the field to which this disclosure belongs. The "one" or "a" or other similar words used in the specification of the present disclosure and the claims do not mean a limit of quantity, but mean that there is at least one. Unless otherwise stated, "including" or "comprising" or other similar words mean that the elements or objects before "including" or "comprising" contains the elements or objects or their equivalents listed after "including" or "comprising", and other elements or objects are not excluded. Similar words such as "connection" or "connect" are not limited to physical or mechanical connections, and may include electrical connections, no matter whether direct or indirect. The singular forms of "a", "the" and "this" used in the specification and claims of this disclosure are also intended to include plural forms, unless the context clearly indicates other meanings. It should also be understood that the term "and/or" as used herein refers to any or all possible combinations of one or more associated listed items.

Figure 1:
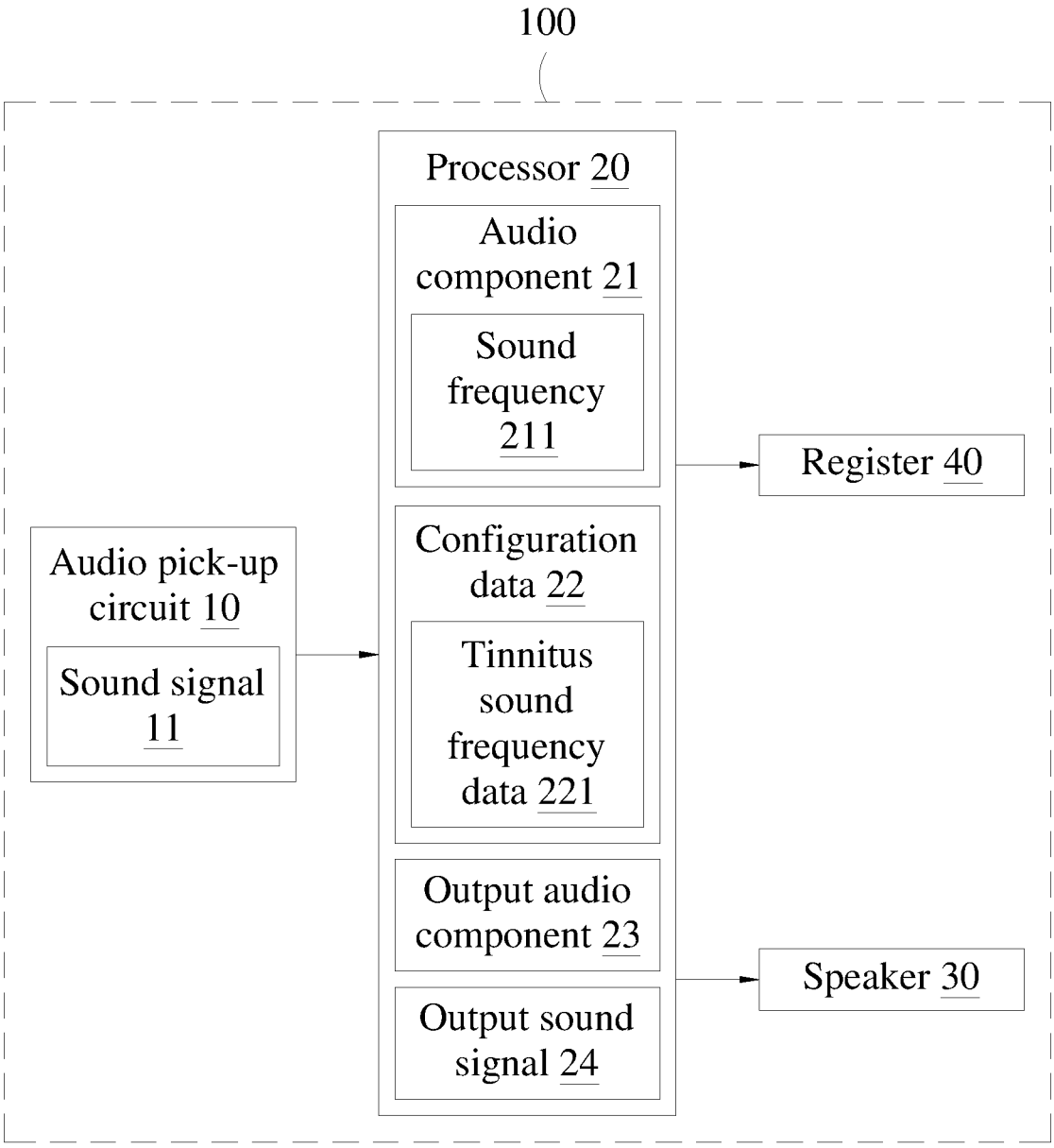
FIG. 1 illustrates a schematic diagram of elements configuration of the present disclosure.

Please refer to FIG. 1 which is a schematic diagram of elements configuration of the present disclosure. As shown in the figure, a tinnitus shielding device primarily consists of an audio pick-up circuit 10, a processor 20, and a speaker 30 in a case 100. The audio pick-up circuit 10 may specifically be a microphone or other related devices that can receive an external sound, and then generate a sound signal 11.

The processor 20 may specifically be a central processing unit (CPU) or other devices capable of data processing. When the processor 20 is connected to the audio pick-up circuit 10 to receive the sound signal 11 from the audio pick-up circuit 10. At this time, the processor 20 will extract a plurality of audio components 21 in the sound signal 11 (such as external environmental sounds and human voices) first, and then the processor 20 compares a sound frequency 211 in each of the plurality of audio components 21 with at least one target frequency stored in a configuration data 22 set on the processor 20 when each audio components 21 are extracted, to determine whether the sound frequency 211 in the plurality of audio components 21 conforms to the target frequency in the configuration data 22. Wherein the configuration data 22 may specifically record at least one tinnitus sound frequency data 221 (such as the target frequency) that can or may cause tinnitus to a user. The tinnitus sound frequency data 221 may be acquired from set by the user, diagnosed by a doctor, diagnosed by an instrument, or other methods. To generate the configuration data 22 by the sum of the acquired tinnitus sound frequency data 221. Therefore, when the processor 20 compares the sound frequency 211 based on the configuration data 22, each of the tinnitus sound frequency data 221 recorded in the configuration data 22 can be used to compare whether the sound frequency 211 has a corresponding sound frequency.

When the processor 20 compares the sound frequency 211 or a plurality of the sound frequencies 211 (in this embodiment, one sound frequency 211 is taken as an example) that conforming to the configuration data 22, the processor 20 is to generate an output audio component 23 by performing a frequency shifting process for the sound frequency 211. The frequency shifting process herein is to shift the sound frequency 211 to a shifted frequency that other than the target frequency stored in the configuration data 22 (that is, the frequency that does not conform to the tinnitus sound frequency data 221), so as to generate the output audio component 23 with the shifted sound frequency 211. The method to implement the frequency shifting process may include: "frequency transposition", "frequency compression", or "non-linear frequency compression", etc. Relevant frequency shift technology is achieved.

The processor 20 then performs a combining process to combine the output audio component 23 and the audio components 21 those are not shifted when the processor 20 completes the frequency shifting process, so that the output audio component 23 and the audio components 21 those are not shifted are combined to generate an output sound signal 24.

After that, the speaker 30 can receive the output sound signal 24 by connecting with the processor 20, and output the output sound signal 24 to the user for listening. Thus, effectively achieves the effect of automatically shielding the sound frequency which may cause tinnitus discomfort to the user.

In addition, in order to effectively store the above-mentioned data, the tinnitus shielding device may further include a register 40 which is mainly configured to receive and store data. Therefore, when the register 40 is connected to the processor 20, the register 40 is capable to store the configuration data 22, the plurality of audio components 21, the output audio component 23, the sound frequency 211, the output sound signal 24, or a combination of two or more thereof.

Moreover, since the conversion or processing between digital signals or analog signals is a prior art, in the above-mentioned signal receiving or outputting actions, the actions known in the prior art will not be repeated.

Figure 2:
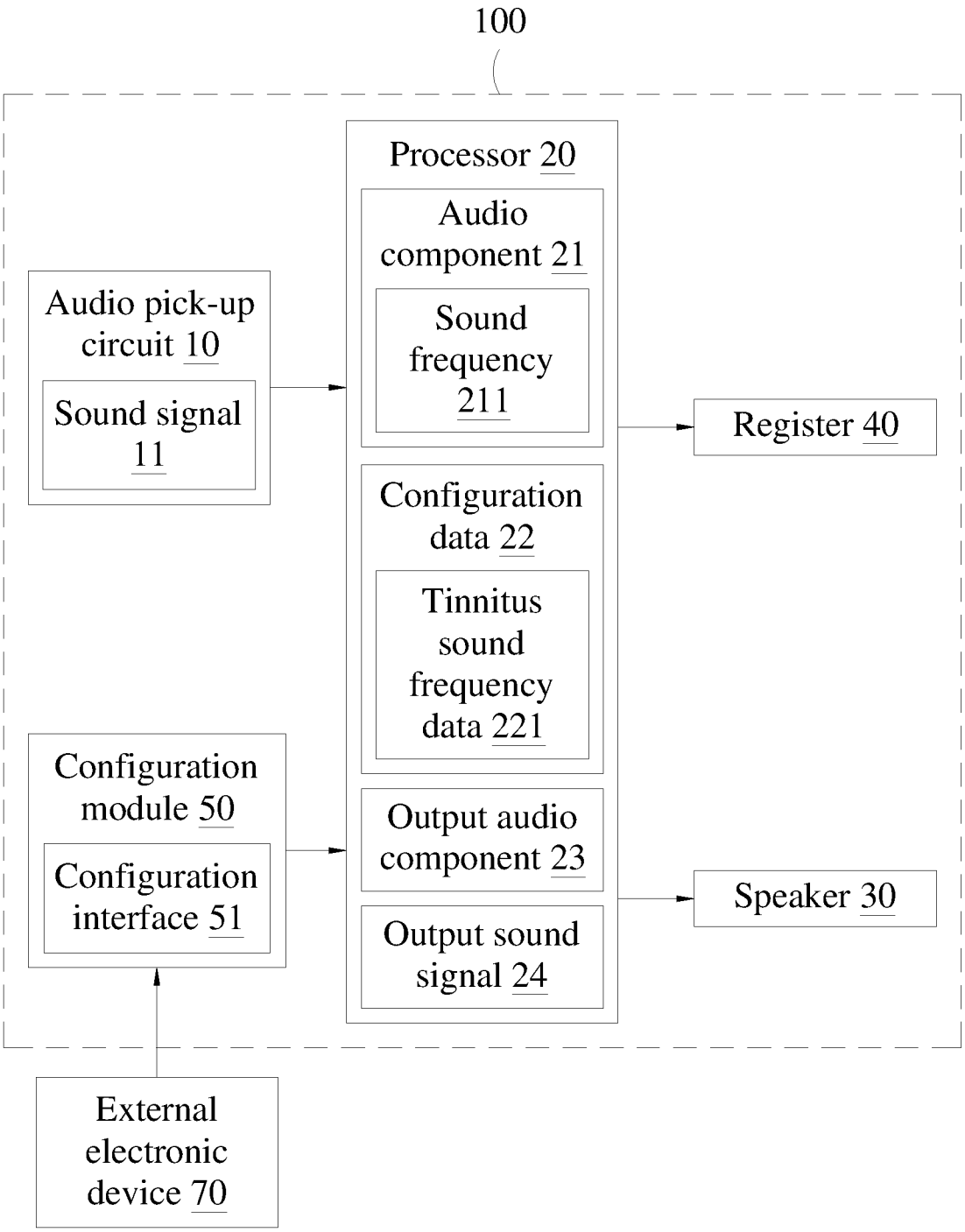
FIG. 2 illustrates a schematic diagram of a configuration module configuration of the present disclosure.

Please further refer to FIG. 2, which is a schematic diagram of a configuration module configuration of the present disclosure. As shown in the figure, in order to provide users, medical personnel, or other related personnel to set the tinnitus sound frequency data 221 for generating the configuration data 22, the tinnitus shielding device of the present disclosure further includes a configuration module 50, which is disposed in the case 100 and connected to an external electronic device 70 (such as a smartphone or a computer) to receive the configuration data 22 set by the user, or the configuration module 50 provides a configuration interface 51 (i.e., an interface 51 for inputting the tinnitus sound frequency data 221 or other related data) to receive the configuration data 22 set by the user. Accordingly, the configuration data 22 can be effectively updated or provided.

Figure 3:
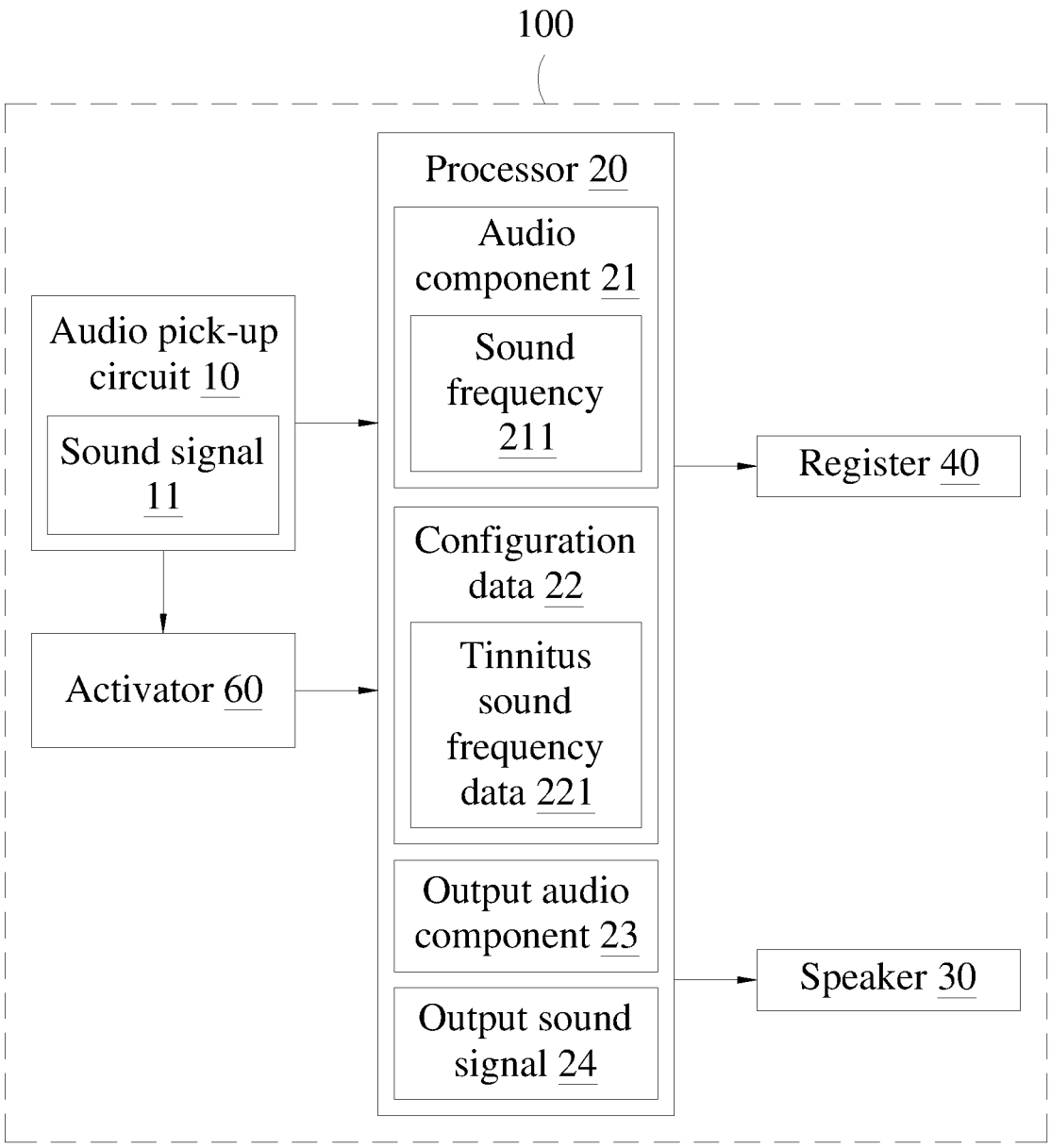
FIG. 3 illustrates a schematic diagram of an activator configuration of the present disclosure.

Please further refer to FIG. 3, which is a schematic diagram of an activator configuration of the present disclosure. As shown in the figure, in order to effectively save power, the tinnitus shielding device of the present disclosure may further include an activator 60, which is disposed in the case 100 and connected to the processor 20 and the audio pick-up circuit 10. The activator 60 activates the processor 20 when the activator 60 receives the sound signal 11 from the audio pick-up circuit 10, so that the processor 20 extracts the plurality of audio components 21 in the sound signal 11. However, when the activator 60 does not receive the sound signal 11, the processor 20 will remain to stay in a standby state. The power-saving function of the tinnitus shielding device of the present disclosure is effectively provided thereby.

Figure 4:
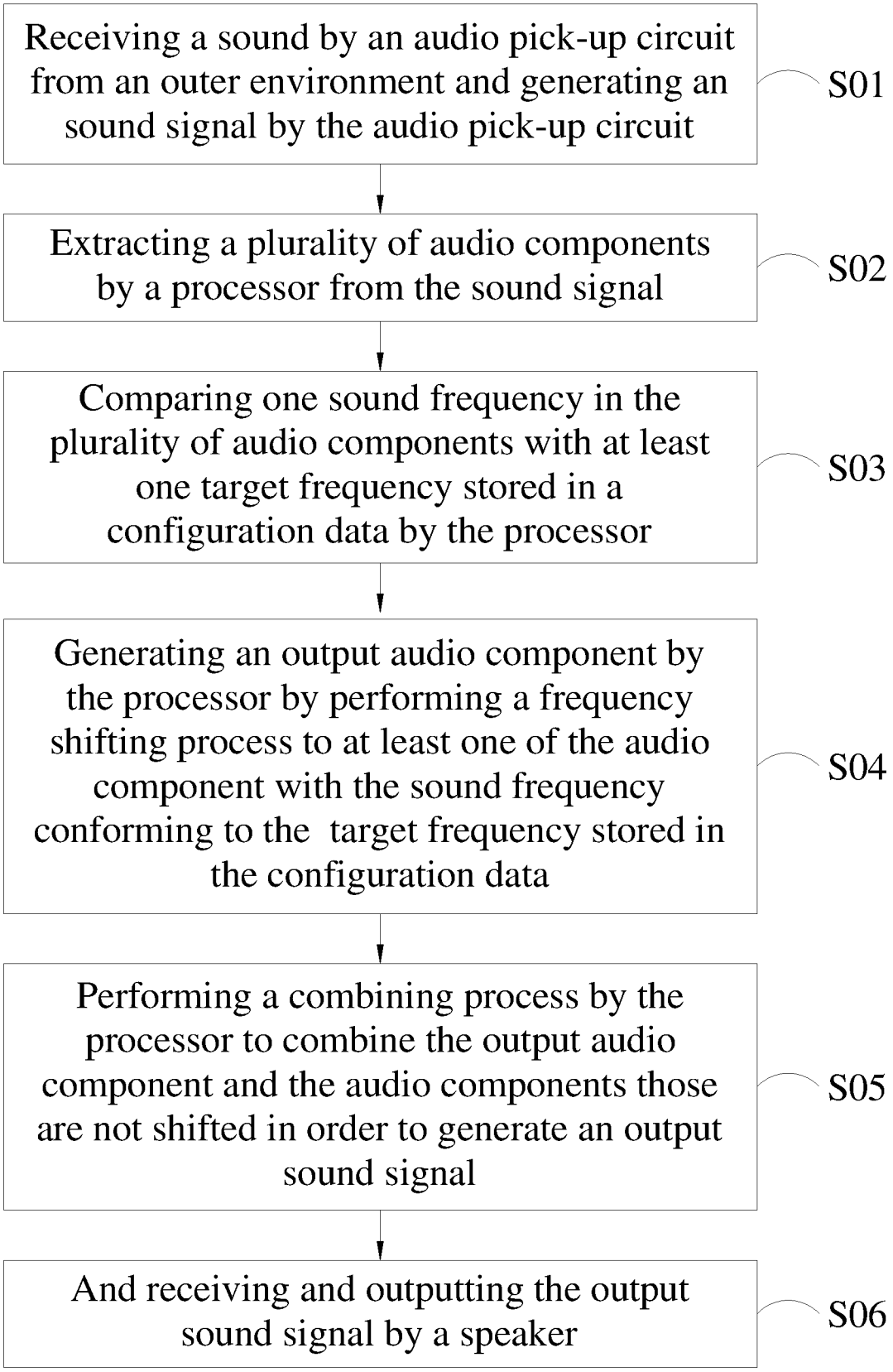
FIG. 4 illustrates a diagram of steps process of the present disclosure.

Please further refer to FIG. 4, which is a diagram of steps process of the present disclosure. As shown in the figure, the effect of automatically shielding the sound frequency as the above-mentioned can be achieved by the following steps process, which includes:

S01: receiving a sound by an audio pick-up circuit from an outer environment and generating a sound signal by the audio pick-up circuit;

S02: extracting a plurality of audio components by a processor from the sound signal;

S03: comparing one sound frequency in the plurality of audio components with at least one target frequency stored in a configuration data by the processor;

S04: generating an output audio component by the processor by performing a frequency shifting process to at least one of the audio component with the sound frequency conforming to the target frequency stored in the configuration data;

S05: performing a combining process by the processor to combine the output audio component and the audio components those are not shifted in order to generate an output sound signal;

S06: and receiving and outputting the output sound signal by a speaker.

Accordingly, the tinnitus shielding device of the present disclosure can effectively and automatically shield the sound frequency which may cause tinnitus discomfort to the user, to avoid the problem with tinnitus thereby.

The above description is merely illustrative rather than restrictive. Any equivalent modifications or alterations without departing from the spirit and scope of the present disclosure are intended to be included in the following claims.

In summary, regardless of the purposes, means, and effects of the present disclosure, which is showing the technical characteristics that are different from the prior art, and it is invented suitable for practical use, and also in compliance with the patent requirements of the present disclosure. Praying that the patent will be granted as soon as possible, so as to benefit society.

What is claimed is:

1. A tinnitus shielding device, comprising:

a case;

an audio pick-up circuit disposed in the case and receiving a sound from an outer environment to generate a sound signal;

a processor disposed in the case and connected to the audio pick-up circuit, the processor receiving the sound signal and extracting a plurality of audio components from the sound signal, comparing a sound frequency in each of the plurality of audio components with at least one target frequency stored in a configuration data and generating an output audio component by performing a frequency shifting process to at least one of the audio component with the sound frequency conforming to the target frequency stored in the configuration data, and performing a combining process to combine the output audio component with the audio components those being not shifted in order to generate an output sound signal; and a speaker disposed in the case and connected to the processor to receive and output the output sound signal.

2. The tinnitus shielding device according to claim 1, wherein the frequency shifting process is performed to shift the sound frequency to a shifted frequency other than the target frequency stored in the configuration data, and the output audio component is generated with the shifted sound frequency.

3. The tinnitus shielding device according to claim 1, wherein the configuration data comprises at least one tinnitus sound frequency data representing the target frequency, the processor compares the sound frequency of the plurality of audio components based on the tinnitus sound frequency data and preforms the frequency shifting process to the audio component having the sound frequency conforming to the tinnitus sound frequency data.

4. The tinnitus shielding device according to claim 3, wherein the frequency shifting process is performed to shift the sound frequency to a shifted frequency other than the target frequency representing by the tinnitus sound frequency data, and the output audio component is generated with the shifted sound frequency.

5. The tinnitus shielding device according to claim 1, comprising:

a register connected to the processor for storing the configuration data, the plurality of audio components, the output audio component, the sound frequencies, the output sound signal, or any combinations of two or more thereof.

6. The tinnitus shielding device according to claim 1, comprising:

a configuration module disposed in the case, the configuration module connected to an external electronic device to receive the configuration data, or the configuration module providing a configuration interface to receive the configuration data set by a user.

7. The tinnitus shielding device according to claim 1, comprising:

an activator disposed in the case and connected to the audio pick-up circuit and the processor, wherein the activator activates the processor to extract the plurality of audio components when the activator receives the sound signal from the audio pick-up circuit, or the processor is in a standby state when the activator does not receive the sound signal.

8. A signal processing method for a tinnitus shielding device, applicable to the tinnitus shielding device, the signal processing method comprising:

receiving a sound by an audio pick-up circuit from an outer environment and generating a sound signal by the audio pick-up circuit;

extracting a plurality of audio components by a processor from the sound signal;

comparing a sound frequency in each of the plurality of audio components with at least one target frequency stored in a configuration data by the processor;

generating an output audio component by the processor by performing a frequency shifting process to at least one of the audio component with the sound frequency conforming to the target frequency stored in the configuration data;

performing a combining process by the processor to combine the output audio component and the audio components those being not shifted in order to generate an output sound signal; and receiving and outputting the output sound signal by a speaker.

9. The signal processing method according to claim 8, wherein the frequency shifting process is performed to shift the sound frequency to a shifted frequency other than the target frequency stored in the configuration data, and the output audio component is generated with the shifted sound frequency.

10. The signal processing method according to claim 8, wherein the configuration data comprises at least one of tinnitus sound frequency data representing the target frequency, the processor compares the sound frequency of the plurality of audio components based on the tinnitus sound frequency data and performs the frequency shifting process to the audio component having the sound frequency conforming to the tinnitus sound frequency data.

11. The signal processing method according to claim 10, wherein the frequency shifting process is performed to shift the sound frequency to a shifted frequency other than the target frequency representing by the tinnitus sound frequency data, and the output audio component is generated with the shifted sound frequency.

12. The signal processing method according to claim 8, comprising:

storing the configuration data, the plurality of audio components, the output audio component, the sound frequencies, the output sound signal, or any combinations of two or more thereof by a register.

13. The signal processing method according to claim 8, comprising:

receiving the configuration data from an external electronic by a configuration module; or providing a configuration interface by the configuration module to receive the configuration data set by a user.

14. The signal processing method according to claim 8, comprising:

activating the processor to extract the plurality of audio components by an activator when the activator received the sound signal from the audio pick-up circuit; or making the processor staying in a standby state when the activator does not receive the sound signal from the audio pick-up circuit.

* * * * *